US006070026A

United States Patent [19]

Claflin, Jr. et al.

[11] Patent Number: 6,070,026

[45] Date of Patent: May 30, 2000

[54] CHARGING DEVICE WITH SEPARATE PRESSURE AND VACUUM AIR FLOWS

[75] Inventors: Alfred J. Claflin, Jr., Ontario; Francisco Zirilli, Penfield, both of N.Y.

[73] Assignee: Xerox Corporation, Stamford, Conn.

[21] Appl. No.: 09/307,967

[22] Filed: May 10, 1999

[51] Int. Cl.[7] ..... G03G 21/00; G03G 15/02

[52] U.S. Cl. ..... 399/92; 361/229

[58] Field of Search ..... 399/92, 93, 98, 399/100, 170; 250/324–26; 347/125, 126; 361/229, 230

[56] References Cited

U.S. PATENT DOCUMENTS

| | | | |
|---|---|---|---|
| 3,862,420 | 1/1975 | Banks et al. | 250/324 |
| 5,128,720 | 7/1992 | Creveling | 399/92 |
| 5,170,211 | 12/1992 | Haupt et al. | 399/93 |

*Primary Examiner*—Joan Pendegrass

[57] ABSTRACT

A charging device includes a housing defining a chamber, the chamber having a floor, the floor having disposed therein an elongated slot pressure port and a plurality of circular hole vacuum ports. Four air flow conduits are disposed under the chamber floor to provide separate pressure air flows and vacuum air flows through the chamber. These four air flow conduits comprise two pressure conduits and two vacuum conduits. The two pressure conduits and two vacuum conduits are respectively connected at one of their ends by two turn-around connectors. Separate pressure air supply connections and vacuum air supply connections are applied to the respective other ends of the two pressure conduits and two vacuum conduits. As a result, pressure air is applied at both ends of the pressure conduit adjacent to the floor, thus causing pressure air flow through the pressure port and into the chamber. Simultaneously, vacuum air is applied at both ends of the vacuum conduit adjacent to the floor, thus causing vacuum air flow to be extracted from the chamber through the vacuum ports. The pressure air flow and the vacuum air flow combine to provide continuous air flow through the chamber.

38 Claims, 7 Drawing Sheets

CHARGING DEVICE WITH SEPARATE PRESSURE AND VACUUM AIR FLOWS

FIELD OF THE DISCLOSURE

This disclosure pertains generally to charging devices used in electrophotographic printing and, in particular, to a charging device with separate pressure and vacuum air flows.

BACKGROUND OF THE INVENTION

It is known to use charging devices in electrophotographic printing. Such charging devices are typically of the following types: corotron, dicorotron, pin corotron, scorotron, discorotron, and pin scorotron. See, generally, R. M. Schaffert, "Electrophotography," The Focal Press, New York, 1965.

As known, such charging devices include a chamber arranged with a charge-generating element such as, for example, a wire, a dielectric wire, or a pin array. As part of the charge-generating process, however, unwanted gases such as nitrous oxide and ozone are generated in the chamber. Some problems associated with these unwanted gases in charging devices are discussed in Louis Reale, U.S. Pat. No. 4,585,322 at col. 2–3, and in Joseph H. Lang et al., U.S. Pat. No. 4,792,680 at col. 1–3.

To provide for proper operation of the charging device, therefore, it is desirable to arrange the charging device to facilitate the evacuation of such gases from the chamber.

To evacuate unwanted gases from the chamber, existing charging devices typically arranged with a single inboard-end vacuum arrangement that results in a large inboard-to-outboard flow gradient that requires substantial flow rates for emissions removal. This existing technology leads to non-uniform vacuum gradient that is higher at the outboard side. Also, this existing technology leads to the introduction of airborne contaminants resident inside the host printing or copying machine. Computed flow fields for a typical charging device using this single-end vacuum arrangement show velocity gradients of 2 to 3× from inboard to outboard. Due to the non-uniformity of the vacuum air flow, high flow rates are required to effectively remove ozone over the entire length of the device. Even at these high flow rates, greater than 3 cubic feet per minute ("CFM"), it is not guaranteed that the induced flow will overcome the effect of corona wind.

As a result, it is desirable to provide an improved charging device.

SUMMARY OF THE INVENTION

There is provided a charging device with separate pressure and vacuum air flows, in accordance with the present invention.

In one aspect of the invention, a charging device comprises a housing defining a chamber as defined by a floor, an inboard end, an outboard end, a length extending between the inboard end and the outboard end, a downstream side, and an upstream side. The chamber has a pressure port disposed in a pressure section of the floor and a vacuum port disposed in a vacuum section of the floor. As a result, when pressure air flow is introduced into the chamber through the pressure port and vacuum air flow is extracted from the chamber through the vacuum port, air flow is created through the chamber.

In another aspect of the invention, a printing machine is arranged with a charging device with separate pressure and vacuum air flows, as described above.

DESCRIPTION OF THE PREFERRED EMBODIMENTS

Figure 1:
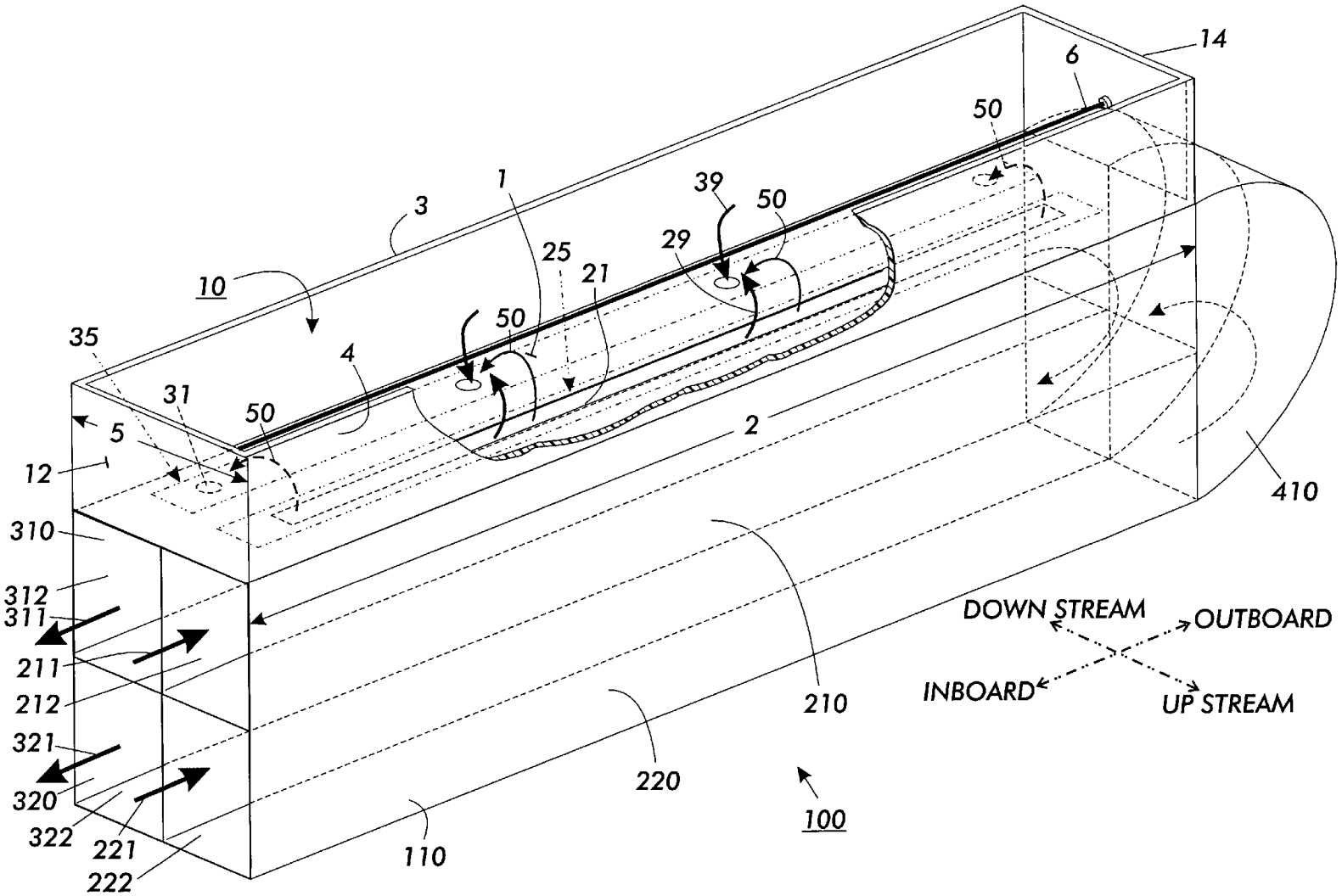
FIG. 1 is a perspective view of one embodiment of a charging device with separate pressure and vacuum air flows, in accordance with the present invention.

Referring now to FIG. 1, there is shown a perspective view of one embodiment of a charging device 100 with separate pressure and vacuum air flows, in accordance with the present invention. As shown, the charging device 100 includes a housing 110 defining a chamber 10, the chamber 10 being defined by a floor 1, an inboard end 12, an outboard end 14, a length 2 extending between the inboard end 12 and the outboard end 14, a downstream side 3, and an upstream side 4. A pressure port 21 is disposed in a pressure section 25 of the floor 1, the pressure section 25 extending along the length 2 near the upstream side 4. A vacuum port 31 is disposed in a vacuum section 35 of the floor 1, the vacuum section 35 extending along the length 2 near the downstream side 3.

It will be appreciated that charging device 100 is arranged for mounting a charge-generating element between the inboard end 12 and outboard end 14. A typical charge-generating device 6, for example, comprises an electrode wire, which may be a bare wire, a dielectric-coated wire, or a pin array. Optionally, the charging device 100 further may be arranged for mounting a voltage-control grid such as, for example, a screen, proximate to the charge-generating device. For ease in understanding the present disclosure, however, only an electrode wire 6 has been shown as the charge-generating device, and the optional voltage-control grid elements have been omitted from FIG. 1.

Still referring to FIG. 1, it will be appreciated that the charging device 100 is arranged so that, when pressure air flow 29 is introduced into the chamber 10 through pressure port 21 and vacuum air flow 39 is extracted from the chamber 10 through vacuum port 31, air flow 50 is created through chamber 10. The chamber air flow 50, in turn, evacuates unwanted gases such as nitrous oxide and ozone from the chamber 10, the unwanted gases being generated by the charge-generating process described above.

Figure 5:
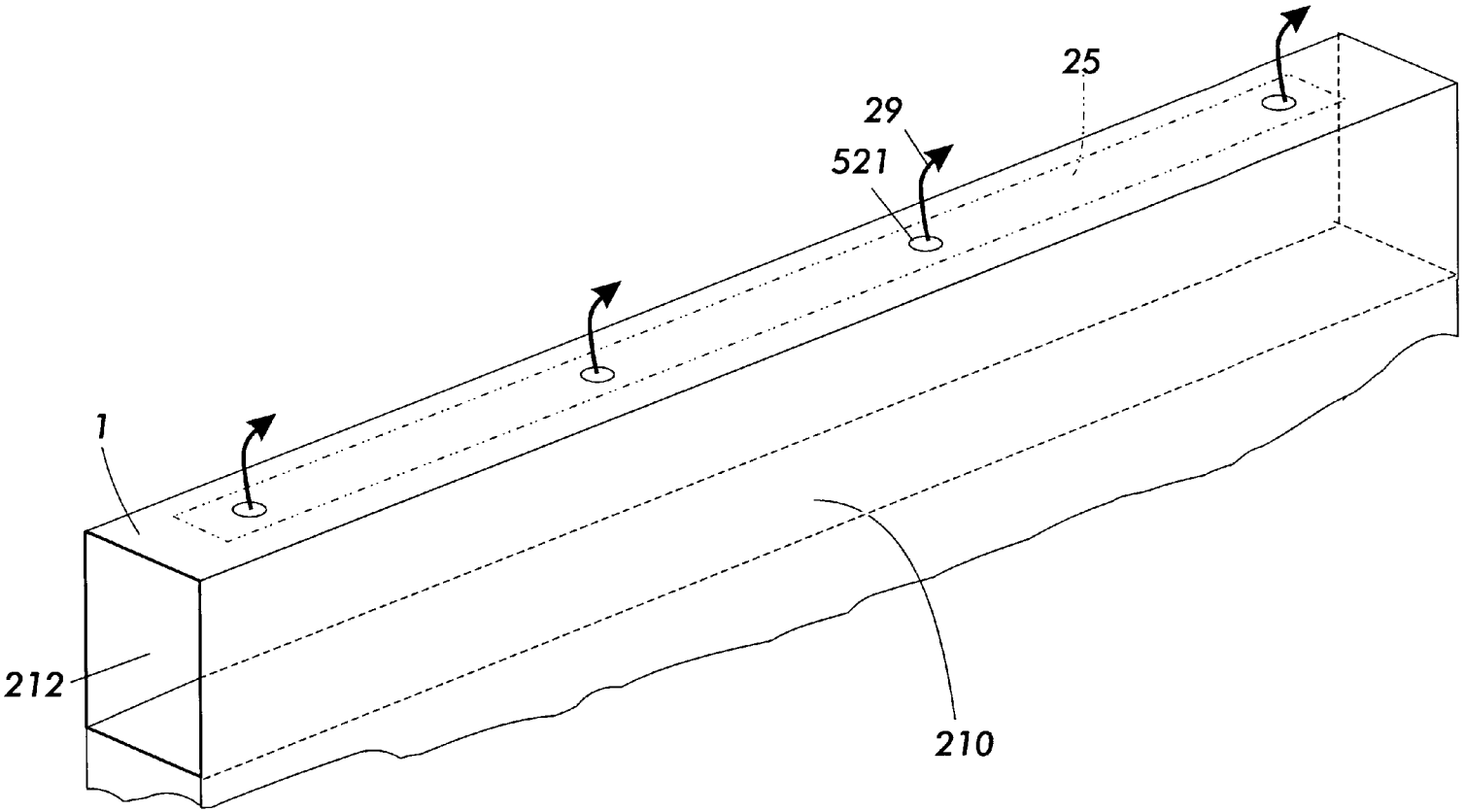
FIG. 5 shows another embodiment of the FIG. 1 charging device.

As shown in FIG. 1, the pressure port 21 comprises an elongated slot disposed along the length 2. Alternatively, the pressure port 21 may comprise a plurality of substantially circular holes disposed at substantially regular intervals along the length 2, this alternate embodiment being depicted as the pressure port 521 in FIG. 5.

Figure 6:
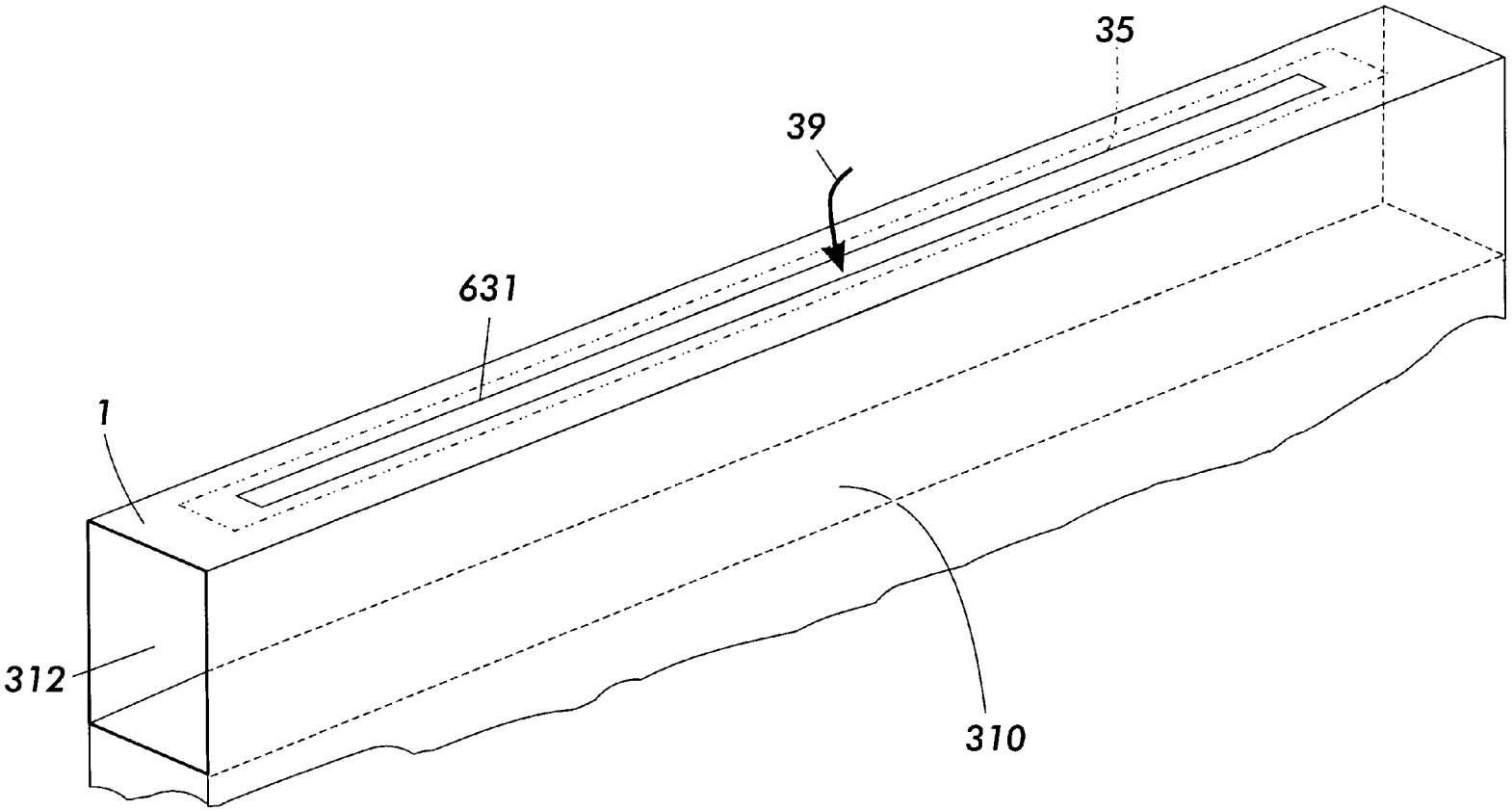
FIG. 6 shows still another embodiment of the FIG. 1 charging device.

Also as shown in FIG. 1, the vacuum port 31 comprises a plurality of substantially circular holes disposed at substantially regular intervals along the length 2. Alternatively, the vacuum port 31 may comprise an elongated slot disposed along the length 2, this alternate embodiment being depicted as the vacuum port 631 in FIG. 6.

Figure 2:
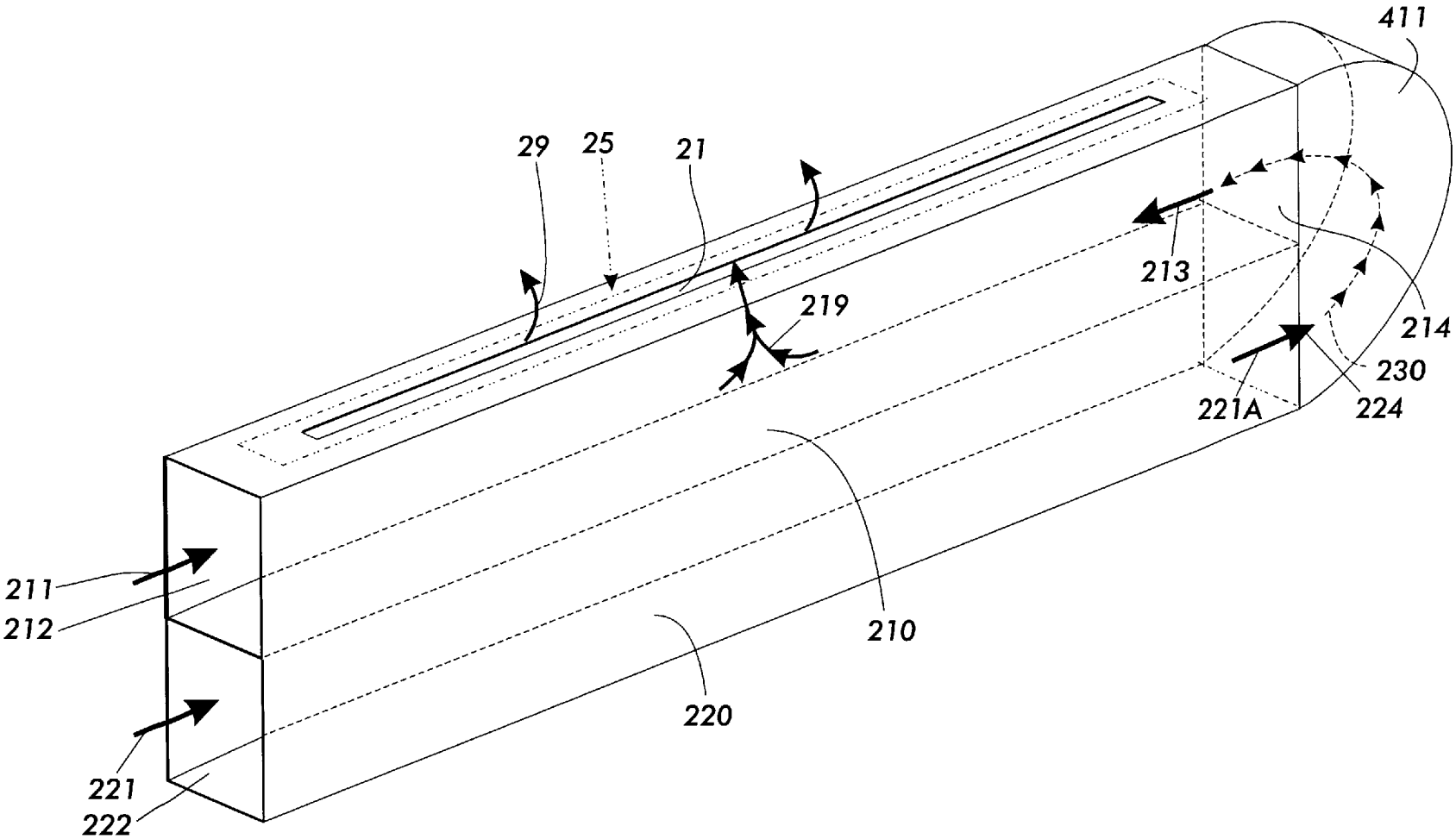
FIG. 2 is a perspective view of a first pressure conduit and a second pressure conduit of the FIG. 1 charging device.
Figure 4:
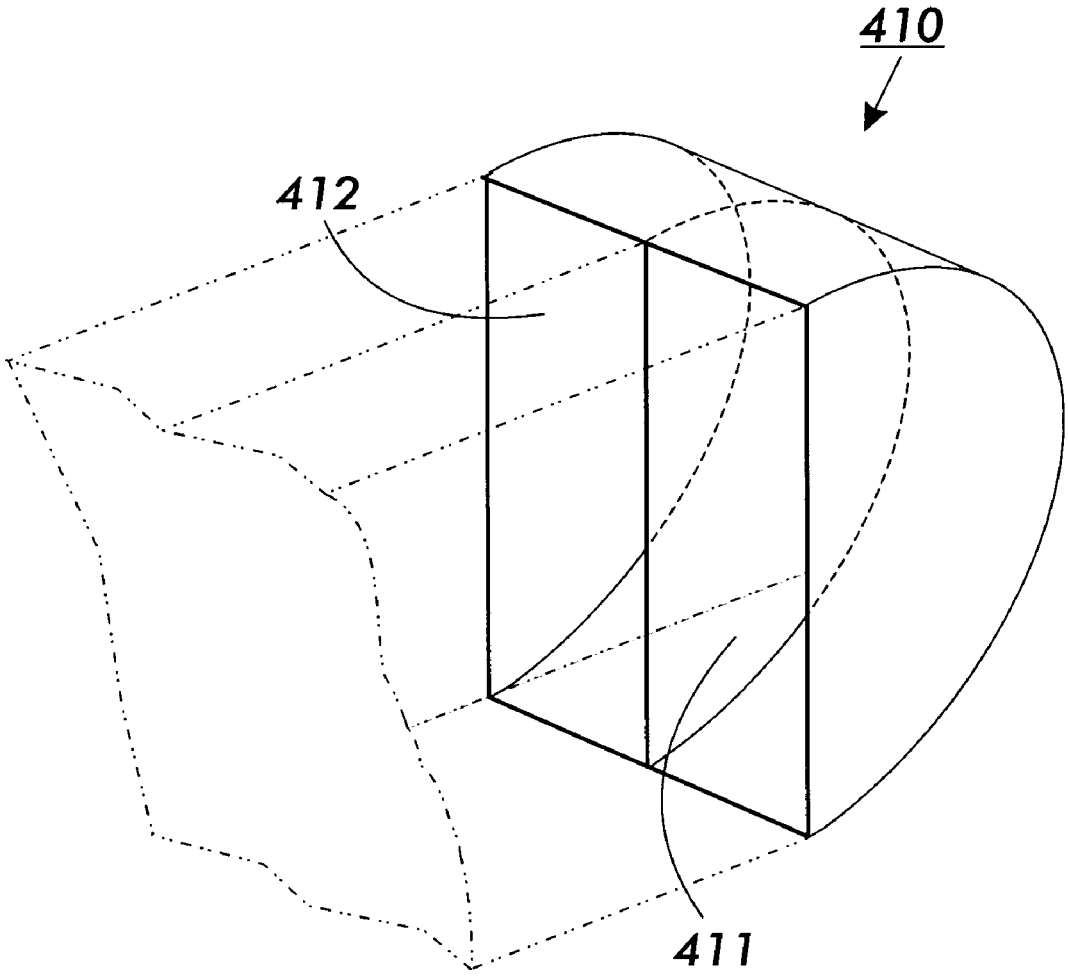
FIG. 4 is a perspective view of a first 180 degree turn-around connector and a second 180 degree turn-around connector of the FIG. 1 charging device.

Referring again to FIG. 1, with reference to FIGS. 2 and 4, it is seen the pressure air flow 29 is supplied by a first pressure conduit 210 disposed under the floor adjacent to the pressure section 25, the first pressure conduit 210 having an inboard opening 212 and an outboard opening 214. Also, a second pressure conduit 220 is disposed underneath and adjacent to the first pressure conduit 210, the second pressure conduit 220 having an inboard opening 222 and an outboard opening 224, the second pressure conduit 220 outboard opening 224 being coupled 230 to the first pressure conduit 210 outboard opening 214 by means of a first 180 degree turn-around connector 411.

Figure 3:
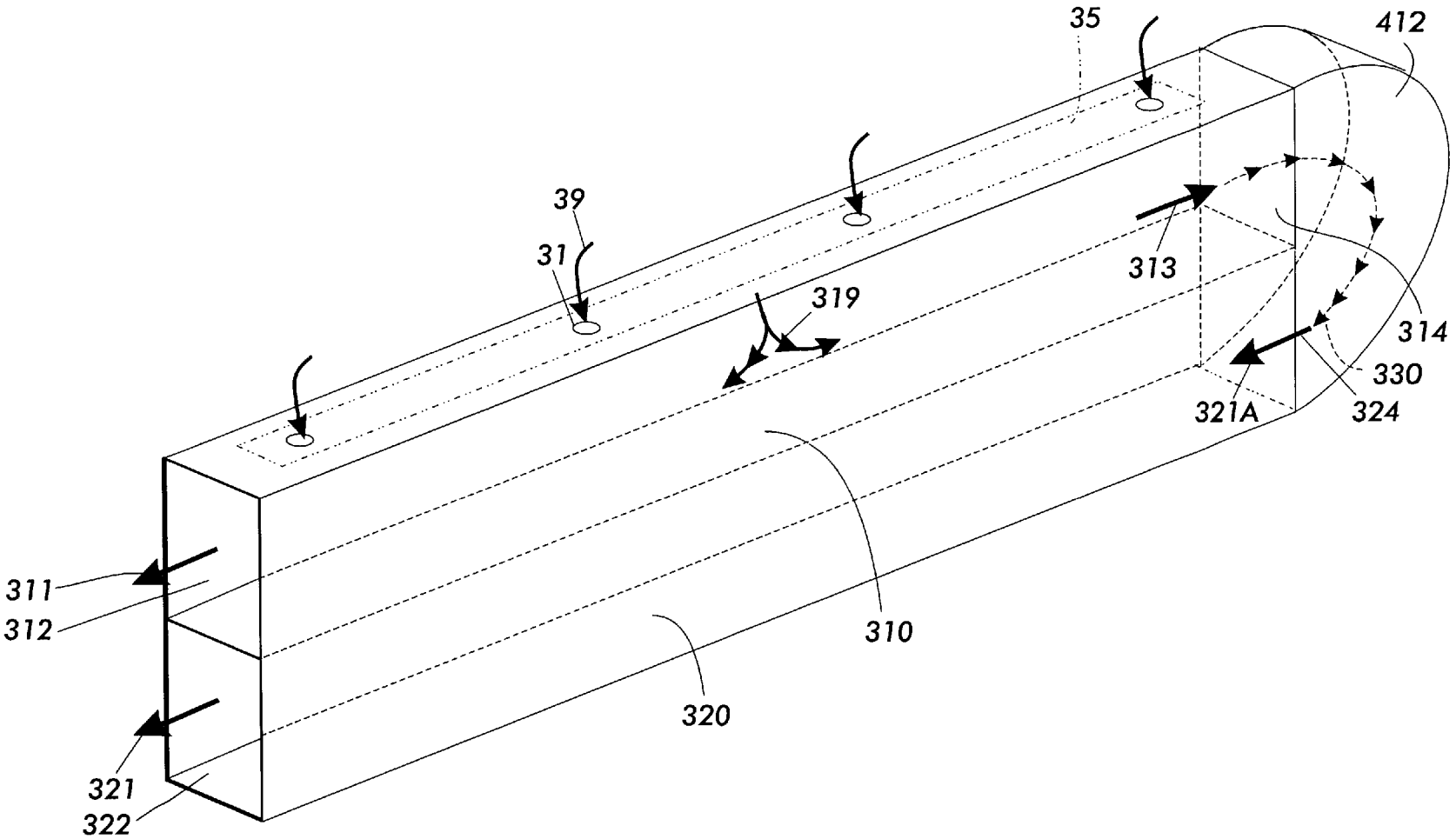
FIG. 3 is a perspective view of a first vacuum conduit and a second vacuum conduit of the FIG. 1 charging device.

Still referring to FIG. 1, with reference to FIGS. 3–4, it is seen the vacuum air flow 39 is supplied by a first vacuum conduit 310 disposed under the floor adjacent to the vacuum section 35, the first vacuum conduit 310 having an inboard opening 312 and an outboard opening 314. Also, a second vacuum conduit 320 is disposed underneath and adjacent to the first vacuum conduit 310, the second vacuum having an inboard opening 322 and an outboard opening 324, the second vacuum conduit 320 outboard opening 324 being coupled 330 to the first vacuum conduit 310 outboard opening 314 by means of a second 180 degree turn-around connector 412.

As shown in FIGS. 1–3, the cross sections of the first and second pressure conduits and the first and second vacuum conduits are each substantially rectangular. In alternate embodiments, the cross sections of any or all of these conduits are of non-rectangular shapes such as, for example, oval, circular, or other shapes.

In practice, referring to FIG. 2, pressure air flows 211 and 221 are simultaneously applied to the first pressure conduit 210 and second pressure conduit 220 inboard ends 212 and 222, respectively. As a result of the coupling provided by the first turn-around connector 411, the pressure air flow 221 is re-directed 230 and applied to the first pressure conduit 210 outboard end 214, this re-directed pressure air flow being depicted in FIG. 2 as element 213. This pressure air flow re-direction 230 results in the two pressure air flows 211 and 213 being respectively applied to both the inboard end 211 and the outboard end 214 of the first pressure conduit 210. These two pressure air flows 211 and 213 combine 219, thus resulting in pressure air flow 29 being introduced into the chamber 10 through pressure port 21.

As well, with reference to FIG. 3, vacuum air flows 311 and 321 are simultaneously applied to the first vacuum conduit 310 and second vacuum conduit 220 inboard ends 312 and 322, respectively. As a result of the coupling provided by the second turn-around connector 412, the vacuum air flow 321 is re-directed 330 and applied to the first vacuum conduit 310 outboard end 314, this re-directed vacuum air flow being depicted in FIG. 3 as element 313. This vacuum air flow re-direction 330 results in the two vacuum air flows 311 and 313 being respectively applied to both the inboard end 311 and the outboard end 314 of the first vacuum conduit 310. These two vacuum air flows 311 and 313 combine 319, thus resulting in vacuum air flow 39 being extracted from the chamber 10 through vacuum port 31.

Moreover, with reference to FIG. 1, as a result of introducing pressure air flow 29 into the chamber 10 through pressure port 21 and extracting vacuum air flow 39 from the chamber 10 through vacuum port 31, air flow 50 is created through the chamber 10. The air flow 50, in turn, evacuates gases from the chamber.

Figure 7:
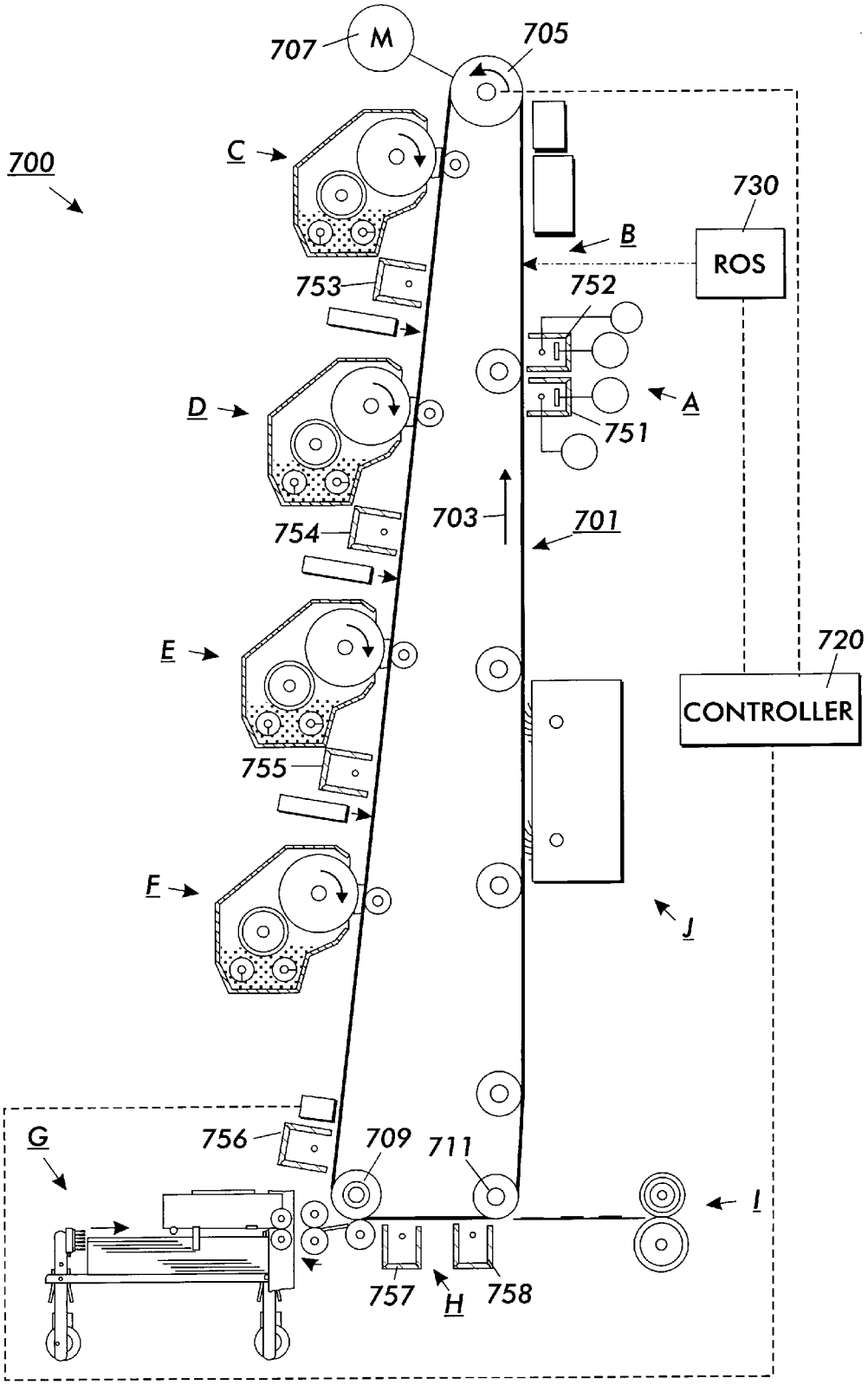
FIG. 7 shows a first embodiment of a printing having the FIG. 1 charging device therein.

It will be appreciated that a printing machine may be arranged with a charging device with separate pressure and vacuum air flows, in accordance with the present invention. Referring now to FIG. 7, for example, there is shown an exemplary printing machine 700 arranged with a charging device in accordance with the present invention.

As shown in FIG. 7, the printing machine 700 uses a photoreceptor belt 701 supported for movement in the direction indicated by arrow 703 for advancing sequentially through various xerographic process stations designated A–J. The belt is entrained about a drive roller 705, tension roller 709 and fixed roller 711. The roller 705 is operatively connected to a drive motor 707 for effecting movement of the belt through the stations A–J.

Still referring to FIG. 7, a portion of belt 701 passes through charging station A where a corona generating device comprising first and second charging devices 751 and 752 charges the photoconductive surface of belt 701 to a relatively high, substantially uniform, negative potential.

Next, the charged portion of photoconductive surface is advanced through an imaging/exposure station B. At imaging/exposure station B, a scanning device 730 causes the charge retentive surface 701 to be discharged based on image signals received from controller 720 representing the desired output image. Preferably the scanning device 730 is a laser Raster Output Scanner (ROS). Alternatively, the scanning device 730 may comprise other xerographic exposure devices, such as LED arrays.

The photoreceptor 701 then moves in sequence to the four (4) development stations respectively designated C–F where, at each respective station, a first, second, third, and fourth toner is applied to the photoreceptor surface 701 based on the particular image or exposure that was charged on the photoreceptor surface 701 by the scanning device 730. Note that the three (3) development stations C–E each respectively include third, fourth and fifth charging devices designated 753–755.

Subsequent to image development, a sheet feeding station G advances a sheet of substrate such as, for example, paper, to transfer station H. Note that sheet feeding station G includes a sixth charging device designated 756.

Next, the sheet of substrate is moved into contact with the toner images at transfer station H. Note that transfer station H includes a seventh (transfer) charging device 757 which sprays positive ions onto the backside of the substrate sheet, these positive ions attracting the negatively-charged toner powder images from the belt 701 to the substrate sheet. An eighth (detack) charging device 758 facilitates stripping of the sheets from the belt 701.

After transfer, the substrate sheet separates from the belt 701 and advances to fusing station 1, which permanently affixes the transferred powder image to the substrate sheet.

At the final station J, the residual toner particles carried by the non-image areas on the photoconductive surface 701 are removed using a cleaning brush or plural brush structure.

Still referring to FIG. 7, it will be appreciated that any or all of the eight (8) charging devices designated 751–758 may comprise a charging device with separate pressure and vacuum air flows, in accordance with the present invention.

With further reference to FIGS. 1–3, some advantages of the present invention are now discussed.

To begin, a charging device with separate pressure and vacuum air flows in accordance with the present invention achieves a uniform air flow pattern along the length 2 of chamber 10. This uniform air flow pattern provides for the continuous removal of unwanted gases such as nitrous oxide and ozone from the chamber, thereby preventing such unwanted gases from impinging on the proximate moving photoreceptor belt. Further, this uniform air flow pattern inside the chamber 10 prevents contaminated air surrounding the charging device 100 from being drawn into the charging device. Moreover, it will be appreciated this desired uniform air flow pattern is achieved because the charging device 100 provides, as described above, for the simultaneous application of the two pressure air flows 211 and 213 to both ends 212 and 214 of the first vacuum conduit 210, respectively, and the application of the two vacuum air flows 311 and 313 to both ends 312 and 314 of the first vacuum conduit 310, respectively.

Moreover, a charging device with separate pressure and vacuum air flows, in accordance with the present invention, provides flow uniformity on the pressure and vacuum from center to inboard and from center to outboard within 20 per-cent. Because of this improved uniformity, the required flow to remove ozone and other contaminants is reduced to 1.3 CFM.

Further, a charging device with separate pressure and vacuum air flows, in accordance with the present invention, provides an improved flow pattern inside the chamber 10 by guaranteeing the pressure air flow 29 turns into and combines with the vacuum air flow 39 to form the through-chamber air flow 50 without disturbing the separate air flow induced by the moving photoreceptor, thus effectively eliminating the possibility of air flow impingement on the photoreceptor surface.

While various embodiments of a charging device with separate pressure and vacuum air flows, in accordance with the present invention, have been described above, the scope of the present invention is defined by the following claims.

What is claimed is:

1. A charging device comprising a housing defining a chamber, the chamber defined by a floor, a first end, a second end, a length extending between the first end and the second end, a first side, a second side, the chamber having a pressure port disposed in a pressure section of the floor and a vacuum port disposed in a vacuum section of the floor, so that when pressure air flow is introduced into the chamber through the pressure port and vacuum air flow is extracted from the chamber through the vacuum port, air flow is created through the chamber, the charging device further comprising a charge-generating element mounted in the chamber, the pressure section extending along the length near the second side, the pressure port comprising a plurality of substantially circular holes disposed at substantially regular intervals along the length.

2. A charging device comprising a housing defining a chamber, the chamber defined by a floor, a first end, a second end, a length extending between the first end and the second end, a first side, a second side, the chamber having a pressure port disposed in a pressure section of the floor and a vacuum port disposed in a vacuum section of the floor, so that when pressure air flow is introduced into the chamber through the pressure port and vacuum air flow is extracted from the chamber through the vacuum port, air flow is created through the chamber, the charging device further comprising a charge-generating element mounted in the chamber, the vacuum section extending along the length near the first side, the vacuum port comprising a plurality of substantially circular holes disposed at substantially regular intervals along the length.

3. The charging device of claim 2, the pressure section extending along the length near the second side.

4. The charging device of claim 3, the pressure port comprising an elongated slot disposed along the length.

5. A charging device comprising a housing defining a chamber, the chamber defined by a floor, a first end, a second end, a length extending between the first end and the second end, a first side, a second side, the chamber having a pressure port disposed in a pressure section of the floor and a vacuum port disposed in a vacuum section of the floor, so that when pressure air flow is introduced into the chamber through the pressure port and vacuum air flow is extracted from the chamber through the vacuum port, air flow is created through the chamber, the charging device further comprising a charge-generating element mounted in the chamber, including a first pressure conduit disposed under the floor adjacent to the pressure section, the first pressure conduit including a first pressure conduit first end opening and a first pressure conduit second end opening, and a first vacuum conduit disposed under the floor adjacent to the vacuum section, the first vacuum conduit having a first vacuum conduit first end opening and a first vacuum conduit second end opening.

6. The charging device of claim 5, including a second pressure conduit disposed adjacent to the first pressure conduit, the second pressure conduit having a second pressure conduit first end opening and a second pressure conduit second end opening, the first pressure conduit second end opening coupled to the second pressure conduit second end opening by means of a first turn-around connector, and a second vacuum conduit disposed adjacent to the first vacuum conduit, the second vacuum conduit having a second vacuum conduit first end opening and a second vacuum conduit second end opening, the first vacuum conduit second end opening coupled to the second vacuum conduit second end opening by means of a second turn-around connector.

7. The charging device of claim 6, the first and second pressure conduits and the first and second vacuum conduits having substantially rectangular cross sections.

8. The charging device of claim 7, the pressure section extending along the length near the second side.

9. The charging device of claim 8, the pressure port comprising an elongated slot disposed along the length.

10. The charging device of claim 7, the vacuum section extending along the length near the first side.

11. The charging device of claim 10, the vacuum port comprising a plurality of substantially circular holes disposed at substantially regular intervals along the length.

12. The charging device of claim 6, the pressure section extending along the length near the second side.

13. The charging device of claim 12, the pressure port comprising an elongated slot disposed along the length.

14. The charging device of claim 6, the vacuum section extending along the length near the first side.

15. The charging device of claim 14, the vacuum port comprising a plurality of substantially circular holes disposed at substantially regular intervals along the length.

16. The charging device of claim 5, the pressure section extending along the length near the second side.

17. The charging device of claim 16, the pressure port comprising an elongated slot disposed along the length.

18. The charging device of claim 5, the vacuum section extending along the length near the first side.

19. The charging device of claim 18, the vacuum port comprising a plurality of substantially circular holes disposed at substantially regular intervals along the length.

20. A printing machine including a charging device, the charging device comprising a housing defining a chamber, the chamber defined by a floor, a first end, a second end, a length extending between the first end and the second end, a first side, a second side, the chamber having a pressure port disposed in a pressure section of the floor and a vacuum port disposed in a vacuum section of the floor, so that when pressure air flow is introduced into the chamber through the pressure port and vacuum air flow is extracted from the chamber through the vacuum port, air flow is created through the chamber, the charging device further comprising a charge-generating element mounted in the chamber, the pressure section extending along the length near the second side, the pressure port comprising a plurality of substantially circular holes disposed at substantially regular intervals along the length.

21. A printing machine including a charging device, the charging device comprising a housing defining a chamber, the chamber defined by a floor, a first end, a second end, a length extending between the first end and the second end, a first side, a second side, the chamber having a pressure port disposed in a pressure section of the floor and a vacuum port disposed in a vacuum section of the floor, so that when pressure air flow is introduced into the chamber through the pressure port and vacuum air flow is extracted from the chamber through the vacuum port, air flow is created through the chamber, the charging device further comprising a charge-generating element mounted in the chamber, the vacuum section extending along the length near the first side, the vacuum port comprising a plurality of substantially circular holes disposed at substantially regular intervals along the length.

22. The printing machine of claim 21, the pressure section extending along the length near the second side.

23. The printing machine of claim 22, the pressure port comprising an elongated slot disposed along the length.

24. A printing machine including a charging device, the charging device comprising a housing defining a chamber, the chamber defined by a floor, a first end, a second end, a length extending between the first end and the second end, a first side, a second side, the chamber having a pressure port disposed in a pressure section of the floor and a vacuum port disposed in a vacuum section of the floor, so that when pressure air flow is introduced into the chamber through the pressure port and vacuum air flow is extracted from the chamber through the vacuum port, air flow is created through the chamber, the charging device further comprising a charge-generating element mounted in the chamber, including a first pressure conduit disposed under the floor adjacent to the pressure section, the first pressure conduit including a first pressure conduit first end opening and a first pressure conduit second end opening, and a first vacuum conduit disposed under the floor adjacent to the vacuum section, the first vacuum conduit having a first vacuum conduit first end opening and a first vacuum conduit second end opening.

25. The printing machine of claim 24, including a second pressure conduit disposed adjacent to the first pressure conduit, the second pressure conduit having a second pressure conduit first end opening and a second pressure conduit second end opening, the first pressure conduit second end opening coupled to the second pressure conduit second end opening by means of a first turn-around connector, and a second vacuum conduit disposed adjacent to the first vacuum conduit, the second vacuum conduit having a second vacuum conduit first end opening and a second vacuum conduit second end opening, the first vacuum conduit second end opening coupled to the second vacuum conduit second end opening by means of a second turn-around connector.

26. The printing machine of claim 25, the first and second pressure conduits and the first and second vacuum conduits having substantially rectangular cross sections.

27. The printing machine of claim 26, the pressure section extending along the length near the second side.

28. The printing machine of claim 27, the pressure port comprising an elongated slot disposed along the length.

29. The printing machine of claim 26, the vacuum section extending along the length near the first side.

30. The printing machine of claim 29, the vacuum port comprising a plurality of substantially circular holes disposed at substantially regular intervals along the length.

31. The printing machine of claim 25, the pressure section extending along the length near the second side.

32. The printing machine of claim 31, the pressure port comprising an elongated slot disposed along the length.

33. The printing machine of claim 25, the vacuum section extending along the length near the first side.

34. The printing machine of claim 33, the vacuum port comprising a plurality of substantially circular holes disposed at substantially regular intervals along the length.

35. The printing machine of claim 24, the pressure section extending along the length near the second side.

36. The printing machine of claim 35, the pressure port comprising an elongated slot disposed along the length.

37. The printing machine of claim 24, the vacuum section extending along the length near the first side.

38. The printing machine of claim 37, the vacuum port comprising a plurality of substantially circular holes disposed at substantially regular intervals along the length.

* * * * *